US011390508B2

(12) United States Patent
Cadou

(10) Patent No.: US 11,390,508 B2
(45) Date of Patent: Jul. 19, 2022

(54) CONTROL OF A HANDLING MACHINE

(71) Applicant: MANITOU BF, Ancenis (FR)

(72) Inventor: Sylvain Cadou, Ancenis (FR)

(73) Assignee: MANITOU BF, Ancenis (FR)

( * ) Notice: Subject to any disclaimer, the term of this patent is extended or adjusted under 35 U.S.C. 154(b) by 291 days.

(21) Appl. No.: 16/627,133

(22) PCT Filed: Jul. 9, 2018

(86) PCT No.: PCT/EP2018/068554
§ 371 (c)(1),
(2) Date: Dec. 27, 2019

(87) PCT Pub. No.: WO2019/016014
PCT Pub. Date: Jan. 24, 2019

(65) Prior Publication Data

US 2020/0172384 A1 Jun. 4, 2020

(30) Foreign Application Priority Data

Jul. 17, 2017 (EP) ..... 17 181 715.8

(51) Int. Cl.
*B66F 17/00* (2006.01)
*B66F 9/065* (2006.01)
(Continued)

(52) U.S. Cl.
CPC ..... *B66F 17/003* (2013.01); *B66F 9/0655* (2013.01); *B66F 9/0755* (2013.01);
(Continued)

(58) Field of Classification Search
CPC .... B66F 17/003; B66F 9/0655; B66F 9/0755; B66C 13/18; B66C 15/00; B66C 23/905; E02F 9/24; E02F 9/2033
See application file for complete search history.

(56) References Cited

U.S. PATENT DOCUMENTS 5,119,949 A 6/1992 Kishi
5,639,119 A * 6/1997 Plate ..... B62D 49/08 280/754
(Continued)

FOREIGN PATENT DOCUMENTS

CN 1681731 10/2005
CN 100408468 10/2005
(Continued)

OTHER PUBLICATIONS

Chinese Office Action dated Sep. 3, 2020.
(Continued)

*Primary Examiner* — Tyler J Lee
*Assistant Examiner* — Yufeng Zhang
(74) *Attorney, Agent, or Firm* — Berenato & White, LLC

(57) ABSTRACT

The invention relates to a control method for controlling an actuating device (8) in a handling machine (1) comprising a main movable body (2) and a handling arm (6) intended to receive a load that is to be moved, the actuating device being configured to perform a movement of the handling arm in relation to the main body, the method comprising: measuring a parameter indicative of a tilting force applied to the main body in relation to a tilting axis, and stopping or hindering a movement of the handling arm performed or requested when a stopping condition is met, the stopping condition being dependent on the parameter indicative of the measured tilting force, and, in which, when a reinforced operating mode is selected, the stopping condition is also dependent on a parameter representative of the speed of the movement of the handling arm.

15 Claims, 5 Drawing Sheets

(51) Int. Cl.

| | |
|---|---|
| ***B66F 9/075*** | (2006.01) |
| *B66C 13/18* | (2006.01) |
| *B66C 15/00* | (2006.01) |
| *B66C 23/90* | (2006.01) |
| *E02F 9/20* | (2006.01) |
| *E02F 9/24* | (2006.01) |

(52) U.S. Cl.

CPC ..... *B66C 13/18* (2013.01); *B66C 15/00* (2013.01); *B66C 23/905* (2013.01); *E02F 9/2033* (2013.01); *E02F 9/24* (2013.01)

(56) References Cited

U.S. PATENT DOCUMENTS

| | | | | |
|---|---|---|---|---|
| 2007/0229007 | A1 | 10/2007 | Morinaga | |
| 2010/0322753 | A1 | 12/2010 | Brooks et al. | |
| 2012/0039696 | A1 | 2/2012 | Brooks et al. | |
| 2013/0238202 | A1* | 9/2013 | Aulton ..... | B66F 9/24 701/50 |

FOREIGN PATENT DOCUMENTS

| | | | |
|---|---|---|---|
| CN | 1950574 | | 4/2007 |
| CN | 102398867 | | 4/2012 |
| CN | 103097279 | | 5/2013 |
| CN | 104961061 | | 10/2015 |
| DE | 102011108874 | | 1/2013 |
| EP | 0731054 | A1 | 9/1996 |
| EP | 2263965 | A1 | 12/2010 |
| EP | 2 733 110 | | 5/2014 |
| JP | S63114730 | A | 5/1988 |
| JP | H05319785 | A | 12/1993 |
| JP | 3252006 | | 1/2002 |
| JP | 2005 273262 | A | 10/2005 |

OTHER PUBLICATIONS

International Search Report dated Sep. 26, 2018.

BSI Standards Publication, "BS EN 280:2013+A1:2015: Mobile elevating work platforms—Design calculations—Stability criteria—Construction—Safety—Examinations and tests", BSI Standards Limited, Sep. 2015 ISBN: 9780580855467.

BSI Standards Publication, "BS EN 1459:1998+A3:2012:Safety of industrial trucks—Self-propelled variable reach trucks", BSI Standards Limited, Mar. 2012; ISBN: 9780580748240.

English language translation of JPH05319785(A).

JCB Work Platform, "Operator's Manual Supplement", JCB Work Platform, 9831-2400-1, Issue 1, Dec. 2015.

Manitou BF, "MLT Operator's Manual", 647082 EN, Manitou, Jul. 4, 2012.

Manitou BF, "MT 1740 Operator's Manual", 547751 EN, Manitou, Jul. 16, 1999.

Soderstrom et al., "System Identification", Prentice Hall International, Series in Systems and Control Engineering, Hemel Hempstead, U.K., 1989; ISBN: 0138812365.

* cited by examiner

CONTROL OF A HANDLING MACHINE

RELATED APPLICATION

This application is a National Phase of PCT/EP2018/068554 filed on Jul. 9, 2018, which claims the benefit of priority from European Patent Application No. 171 81 715.8 filed on Jul. 17, 2017, the entirety of which are incorporated by reference.

TECHNICAL FIELD

The invention relates to the field of handling machines including a main body, generally intended to be positioned on the ground, at least one handling arm intended to receive a payload to be moved, and an actuating device configured for performing a movement of the handling arm relative to the main body, and in particular to travelling handling machines.

Such a machine can particularly be produced in the form of a truck with a telescopic arm, a forklift truck, a hoisting crane, a mechanical digger, a bucket loader or other machine.

TECHNOLOGICAL BACKGROUND

In the field of handling machines, some countries have decided to adopt standards that impose specific requirements on manufacturers in terms of monitoring and controlling the stability of the machine during operation.

The forces at play in the stability of a handling machine during operation involve both gravitational forces, also known as static loads, i.e. the weight of the handling arm, the payload, the main body and/or other elements of the machine, and inertial forces also known as dynamic loads, i.e. accelerations transferred between the handling arm, the payload, the main body and/or other elements of the machine due to the movements performed during operation, particularly the movements of the handling arm and the payload relative to the main body.

The inertial forces can be limited intrinsically by restricting the speed of movement of the members of the machine. Thus, European Standard EN 1459:1998, entitled "Safety of industrial trucks. Self-propelled variable reach trucks" imposes a restriction of the maximum lowering speed of the handling arm. In particular, this standard specifies that this speed be limited so that the sudden stopping of the handling arm loaded with the maximum payload cannot cause the machine to overturn, while permitting a temporary lifting of the rear wheels of the machine.

However, imposing a permanent limitation of the speed is counter to the aim of efficient work that is sought in the field of handling machines. Permanent limitation of the speed cannot therefore constitute a satisfactory general solution to the problem of monitoring and controlling the stability of the machines during operation.

Another well-known solution for reducing the inertial forces exerted on the main body by the handling arm and the payload consists of automatically slowing the movement of the handling arm, in particular when it is approaching an end-of-movement position. Solutions of this type are described particularly in GB-A-1403046, U.S. Pat. No. 4,006,347, EP-A-0059901, U.S. Pat. No. 5,333,533, JP-A-3252006 and GB-A-2390595.

GB-A-2431248 describes a construction machine rotating body provided with an actuating device that meets movement control rules as a function of the speed of the rotating body or the position of the rotating body.

EP-A-2733110 describes a handling machine in which the movement of the handling arm is controlled and modified automatically in an emergency by means of automatic correction measures comprising, for example, the lowering or retraction of the telescopic boom.

EP-A-2736833 describes a handling machine in which the movement of the handling arm is controlled and maintained in each position of the arm at a speed lower than a predetermined maximum travelling speed.

EP-A-2263965 describes a handling machine in which the travelling speed on the ground of the machine is measured to disable certain controls of the machine.

However, operating conditions exist in which the forces applied to a handling machine, and particularly the inertial forces, are difficult to predict and control. In particular, the travel of the machine on the ground in the case of a travelling machine is capable of generating multiple forces outside the control of a system for controlling the handling arm. Thus, the aforementioned European Standard EN 1459:1998 states that a risk of the machine tipping over exists despite the use of an overturning moment control device whenever the machine is travelling on a bend, the machine is travelling on a slope, the machine is travelling over uneven ground or ground with obstacles and holes, or the machine is travelling with the load in the raised position.

It is also known that the truck can overturn forwards when the travelling vehicle brakes, when it is moving a load.

Summary

One idea behind the invention is to provide methods and systems for controlling a handling machine that make it possible to retain the stability of the machine, particularly by taking into account the inertial forces, and that do not limit the usability of the machine when the taking into account of the inertial forces is made inaccurate or ineffective due to the operating conditions.

To this end, the invention provides a handling machine including:

a main body, a handling arm intended to receive a load to be moved, an actuating device configured for performing a movement of the handling arm relative to the main body, an overturning moment indicating sensor sensitive to a quantity indicating an overturning moment applied to the main body relative to an overturning axis, a control unit configured for controlling the actuating device so as to stop or prevent a movement of the handling arm performed or requested as soon as a stopping condition is met, the stopping condition being dependent on the measured quantity indicating the overturning moment, and a selection member that can be actuated by an operator for selecting a simple operating mode and an enhanced operating mode.

According to one embodiment, when the enhanced operating mode is selected, the stopping condition employed by the control unit is also dependent on a quantity representing the speed of the movement of the handling arm performed or requested, and when the simple operating mode is selected, the stopping condition is independent of the quantity representing the speed of the movement of the handling arm.

The invention also provides a control method for controlling an actuating device in a handling machine including a mobile main body and a handling arm intended to receive a load to be moved, the actuating device being configured for performing a movement of the handling arm relative to the main body, the method including:

measuring a quantity indicating an overturning moment applied to the main body relative to an overturning axis, and stopping or preventing a movement of the handling arm performed or requested as soon as a stopping condition is met, the stopping condition being dependent on the measured quantity indicating the overturning moment, and in which, when an enhanced operating mode is selected, the stopping condition is also dependent on a quantity representing the speed of the movement of the handling arm, and when a simple operating mode is selected, the stopping condition is independent of the quantity representing the speed of the movement of the handling arm.

In the enhanced operating mode, the control unit applies a stopping condition that depends on the speed of the movement of the handling arm, or on a quantity representing this speed. This makes it possible to take into account the inertial forces capable of occurring due to this speed, in the event that the movement stops. Different methods based on the speed can be employed for this taking into account. This operating mode is particularly suited to operating conditions in which the body of the machine is stationary, as the inertial forces can be determined with a satisfactory degree of accuracy in this case. In other words, it is then possible to set realistic speed limits for prohibiting or eliminating the movements of the handling arm that actually create a risk of overturning in the event of stopping.

When the simple operating mode is selected, the stopping condition is independent of the quantity representing the speed of the movement of the handling arm. Thus, the handling arm can be controlled more simply. According to one embodiment, when the simple operating mode is selected, the method also includes the step of preventing or stopping the movement of the handling arm as soon as the quantity indicating an overturning moment has crossed a predetermined threshold.

According to embodiments, the handling machine or the control method can include one or more of the following characteristics.

According to one embodiment, the selection member is configured for: selecting the enhanced operating mode in response to a first action by the operator on the selection member, and selecting the simple operating mode in response to a second action by the operator on the selection member.

According to one embodiment, the control unit is configured for selecting the enhanced operating mode in response to the detection of the fact that the main body has remained in a substantially stationary state for a duration longer than a predetermined threshold.

One or more tests can be performed to detect that the main body is in a substantially stationary state, for example to detect the activation of a parking brake, the deactivation of a transmission (disengagement by solenoid valve or electric control relay), the lowering of the stabilizing legs 5 so that they are resting on the ground, or a condition based on the travelling speed of the main body.

According to one embodiment, the machine also includes a travelling speed sensor configured for measuring a quantity representing a travelling speed of the main body, and the control unit is configured for detecting that the main body has remained in a substantially stationary state as a function of the quantity representing a travelling speed of the main body.

According to one embodiment, when the enhanced operating mode is selected, the control unit is configured for determining a threshold representing a maximum permitted speed as a function of the quantity indicating the overturning moment, comparing the quantity representing the speed of the movement performed or to be performed with the threshold representing a maximum permitted speed and controlling the actuating device as a function of the result of said comparison, so as to:

perform or continue the movement of the handling arm while the quantity representing the speed of the movement performed or to be performed is below said threshold, and prevent or stop the movement of the handling arm as soon as the quantity representing the speed of the movement performed or to be performed is above said threshold.

Due to these features, in the enhanced operating mode, a movement of the handling arm performed by the machine is always performed in accordance with the movement request produced by the operator, but this movement is not performed or is interrupted when the operator's request results or would result in a threshold representing a maximum permitted speed being exceeded. In other words, the control unit acts as an on/off filter that performs or allows the performance of the movement requests that meet an authorization criterion, but prevents or cancels the performance of the movement requests that do not meet the authorization criterion. In doing so, the control unit does not need to modify the movement requests issued by the operator, which means that the operator retains effective control of these requests, particularly in terms of speed.

The threshold representing a maximum speed can be determined in different ways, particularly with a view to excluding movements involving an excessive quantity of movement, i.e. a quantity of movement that the machine is not capable of absorbing or dissipating without the risk of creating instability.

According to one embodiment, the machine also includes an overturning moment indicating sensor for measuring a quantity indicating an overturning moment applied to the main body relative to an overturning axis.

The use of such an overturning moment indicating sensor enables the control unit to take into account information relating to the overturning moment at a given time. Such an overturning moment indicating sensor can be arranged in different ways to measure different quantities. According to one embodiment, the overturning moment indicating sensor includes a strain gage, for example a strain gage sensitive to the deformations of an axle of the chassis of the machine (variation in length between two terminals spaced apart on the axle) and/or of the handling arm. According to one embodiment, the overturning moment indicating sensor includes a pressure sensor in the arm actuating device, for example a pressure sensor arranged on a cylinder of the actuating device. According to another example, the overturning moment indicating sensor can be a load cell as mentioned in EP-A-1532065. The overturning moment indicating sensor can also be produced in the form of a measuring system including several sensors measuring several physical quantities and a processing unit to combine these measurements in the form of a quantity indicating the overturning moment.

According to one embodiment, the machine also includes a threshold determining module configured for determining the threshold representing a maximum permitted speed as a function of a measuring signal produced by the overturning moment indicating sensor. According to one embodiment, the threshold representing a maximum permitted speed decreases when the overturning moment increases.

According to one embodiment, the machine also includes a control member that can be actuated by an operator to produce a movement request signal intended to influence the actuating device to have a movement of the handling arm performed or stopped by the actuating device in response to the movement request signal.

According to one embodiment, the overturning moment indicating sensor is arranged on an end portion of the main body facing the opposite way to the direction of the movement performed or to be performed in response to the movement request signal, and the quantity measured by the overturning moment indicating sensor goes in the opposite direction to the overturning moment. Such an embodiment is for example illustrated by the example of a strain gage measuring the deformations of the rear axle of a handling vehicle in which the handling arm extends towards the front of the vehicle.

According to one embodiment, the overturning moment indicating sensor is arranged on an end portion of the main body facing the direction of the movement performed or to be performed in response to the movement request signal, and the quantity measured by the overturning moment indicating sensor goes in the same direction as the overturning moment. Such an embodiment is for example illustrated by the example of a strain gage measuring the deformations of the front axle of a handling vehicle in which the handling arm also extends towards the front of the vehicle.

The movement of the handling arm performed by the actuating device can be of different types, for example a translation or rotation. According to a preferred embodiment, the actuating device is configured for performing a pivoting of the handling arm about a substantially horizontal axis relative to the main body.

The handling arm can have one or more degrees of freedom relative to the main body. When several degrees of movement exist with several actuating devices associated with these respective degrees of movement, the different actuating devices are not necessarily all controlled in the same way. In particular, the control methods described herein are preferably applied to the degree(s) of movement with a greater influence on the stability of the machine.

The quantity representing the speed applied to control the machine can be determined in different ways.

According to one embodiment, the movement request signal has an attribute representing a speed of the movement to be performed and the control member can be actuated by the operator to adjust the attribute of the movement request signal to one of a plurality of attribute values respectively representing a plurality of speed values and a stopped state.

According to one embodiment, the control unit is configured for receiving the movement request signal produced by the control member. In this case, the control unit can take into account an attribute of the movement request signal, for example its amplitude, frequency, duration or any other predefined attribute, as the quantity representing the speed of the movement to be performed. According to one embodiment, the comparison made by the control unit is a comparison between the attribute of the movement request signal and said threshold.

The operator-actuated control member can be produced in different ways, for example in the form of a tilting lever, a control knob, a touch screen, or other member. According to one embodiment, the operator-actuated control member is coupled to the control unit to supply the movement request signal to the control unit in the form of an electric signal. For example, the attribute of the movement request signal that represents the requested speed is a voltage, intensity, frequency or duration level of the request signal.

According to one embodiment, a control method implemented by the control unit includes the step of receiving the movement request signal.

According to other embodiments, the control member producing the movement request signal is not necessarily connected to the control unit or the control unit is not necessarily configured to be able to receive this movement request signal, for example if it is a purely mechanical signal.

According to one embodiment that can be used in this case, the handling machine also includes measuring means for measuring an instantaneous speed of the handling arm relative to the main body. In this case, the comparison made by the control unit can be a comparison between said instantaneous speed and said threshold.

Different methods can be used to measure an instantaneous speed of the handling arm relative to the main body. According to a more direct method, an angular or linear speed sensor can be used. According to a more indirect method, a quantity correlated to the instantaneous speed of the handling arm can be measured, for example the speed of a mobile part coupled to the handling arm or other member. According to one embodiment, in which the actuating device includes a hydraulic actuator, the machine also includes measuring means for measuring the hydraulic flow to be supplied to the hydraulic actuator as speed information. In this case, the comparison made by the control unit can be a comparison between the hydraulic flow and said threshold.

The actuating device(s) of the handling arm can be produced in different ways, for example in the form of one or more electric or hydraulic actuators.

According to one embodiment, the actuating device includes a hydraulic actuator and a variable-flow device for adjusting a hydraulic flow to be supplied to the hydraulic actuator. Such a variable-flow hydraulic device can be produced in different ways.

According to one embodiment, the variable-flow device includes a variable-flow pump. For example, in an inclined rotor pump, the flow adjusting member can influence an angle of inclination of the inclined rotor. According to one embodiment, the variable-flow device includes a proportional spool valve. For example, in a proportional spool valve, the flow adjusting member can influence the position of a slider.

According to one embodiment, the operator-actuated control member is functionally coupled, for example mechanically or hydraulically, to the variable-flow device so as to move a flow adjusting member of the variable-flow device as a function of the operator's action on the control member.

In such a case, the control unit is not necessarily capable of preventing the direct actuation of the variable-flow device by the operator's action on the control member and the production of a resulting hydraulic flow.

According to one embodiment that can be used in this case, the actuating device also includes a solenoid valve arranged between the variable-flow device and the hydraulic actuator, the solenoid valve being controllable by the control unit to prevent or stop the movement of the handling arm as soon as the quantity representing the speed of the movement performed or to be performed is above said threshold.

In such an embodiment, the movement request signal can be a movement of the flow adjusting member of the variable-flow device. Such a movement can be measured by a transducer and supplied in the form of an electric signal to the control unit. However, it is not always possible or desirable to provide such a transducer in the variable-flow device, particularly for reasons relating to the footprint or cost of the variable-flow device. In the absence of such a transducer, the movement request signal cannot be supplied easily to the control unit. In these cases, the control unit can operate on the basis of the measurement of an actual movement of the handling arm rather than on the basis of a movement request signal.

In a preferred embodiment, the solenoid valve is a progressive start-up valve. The use of a progressive start-up valve makes it possible to obtain a reliable measurement of the instantaneous speed of the handling arm before the handling arm has acquired a large quantity of movement, so that the movement can be interrupted without excessive impact in the event that the permitted speed threshold has been exceeded.

According to embodiments, the handling machine or the signaling method can include one or more of the following characteristics.

Certain aspects of the invention are based on the idea of analyzing the energy state of a handling machine into a gravitational potential energy contribution and a kinetic energy contribution. In terms of potential energy, the stability of the machine in the field of gravity results in the positioning of the current state of the machine at the bottom of a potential well, the depth of which can vary depending on the mass and position of the payload. In terms of kinetic energy, the speed of movement of the handling arm relative to the main body results in a quantity of energy capable of being transferred to the main body, with varying efficiency, in the event of a change in the mechanical coupling between them, for example if the movement suddenly stops. One idea behind the invention is controlling and/or enabling an operator to control this kinetic energy so that it does not exceed an energy level such that it becomes capable of taking the handling machine out of the potential well resulting from its stable state.

BRIEF DESCRIPTION OF THE FIGURES

The invention will be more clearly understood, and further aims, features and advantages thereof will become more apparent from the following description of several specific embodiments of the invention, given by way of non-limitative illustration only, with reference to the attached drawings.

DETAILED DESCRIPTION OF THE EMBODIMENTS

The description below relates to embodiments of a handling machine in the form of a travelling telescopic lift truck having a handling arm extending towards the front of the vehicle. In this configuration, the risk of overturning occurs in the forward direction about an overturning axis formed by the front wheels of the vehicle. As such, the monitoring and control of this overturning risk involve taking into account the inertial forces oriented in the forward direction, i.e. the movements involving a considerable quantity of movement in this direction.

In a handling machine having a different configuration, the overturning axis might be in a different location. The movements to be taken into account must then be selected depending on the location of this axis.

Figure 1:
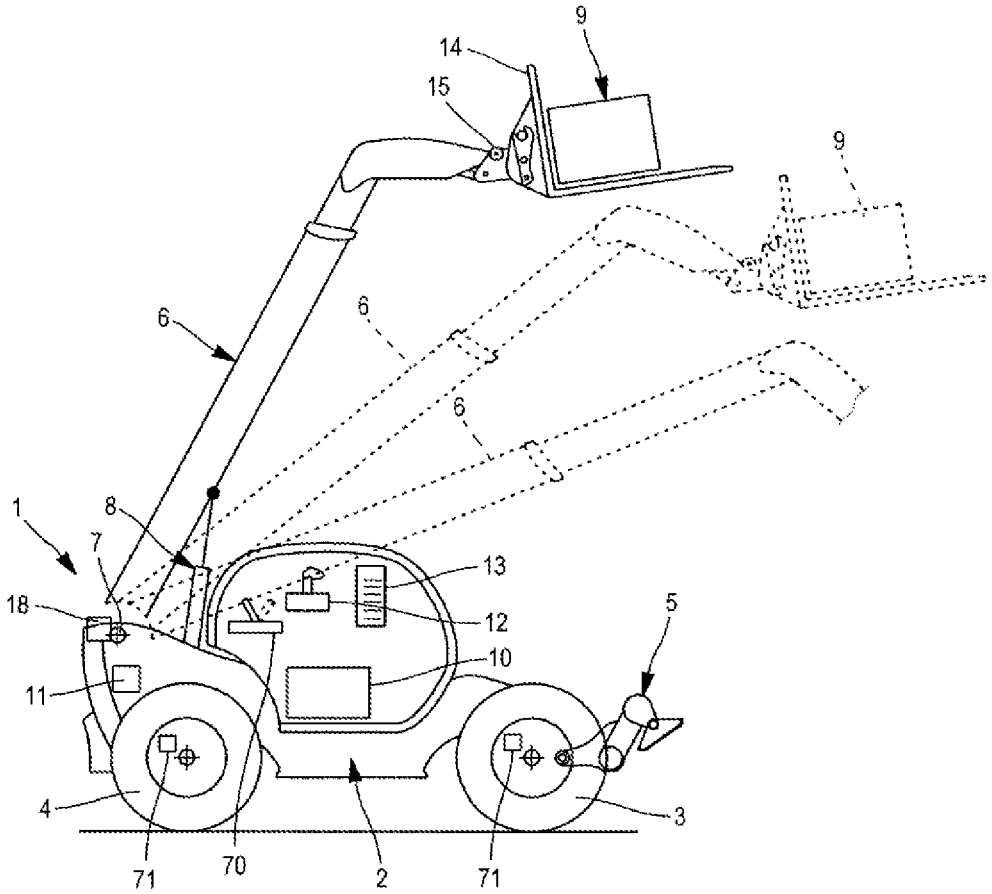
FIG. 1 is a diagrammatic representation of a telescopic lift truck on which embodiments of the invention can be implemented.

With reference to FIG. 1, the telescopic lift truck 1 includes a chassis 2 supported on the ground by means of a front axle 3 and a rear axle 4. Stabilizing legs 5 can optionally be deployed to raise the front axle 3, in which case the stabilizing legs 5 define the forward overturning axis. The chassis 2 has a relatively high mass due to its construction and the mechanical elements that it holds, as known in the prior art.

The handling arm 6 is hinged on the chassis 2 about a horizontal axis 7. A lifting actuator, for example a hydraulic cylinder 8, makes it possible to move the handling arm 6 upwards and downwards about the horizontal axis 7, under the guidance of a control system. The control system includes a control unit 10 and an operator-actuated control member 12, which are diagrammatically shown in FIG. 1.

FIG. 1 illustrates the handling arm 6 and a payload 9 in a top position in solid lines and in several lower positions in dashed lines. All other things being equal, the static overturning moment exerted by the handling arm 6 in the forward direction increases as the position thereof descends towards the horizontal.

A measurement indicating this static overturning moment can be obtained by means of an overturning moment indicating sensor that can be positioned in different ways. FIG. 1 illustrates an overturning moment indicating sensor 11 positioned level with the rear axle, as known in the prior art.

The overturning moment indicating sensor 11 produces a measuring signal that represents a stability reserve of the handling machine 1 relative to the overturning axis.

A known method for monitoring and controlling the overturning risk consists of processing the measuring signal from the overturning moment indicating sensor 11 using the control unit 10 in order to display a visual stability gage in the cab of the machine, for example on an illuminated display panel 13 arranged in the cab, and to interrupt the lowering movement of the handling arm 6 when the measuring signal falls below a predefined threshold. However, due to the inertial forces generated by the interruption of the movement, this method requires that the threshold be set with a high safety margin, which limits the capabilities of the machine, and/or that an automatic slowing of the movement be ordered before interruption, which removes control of the speed from the operator.

To avoid this, in an enhanced operating mode, the control system can implement control methods that will be described with reference to FIGS. 2 and 3. These control methods are based on the principle of allowing the operator to control the movement of the handling arm 6 by means of the control member 12. In particular, the control system governs the speed of the movement to be performed as a function of a movement request produced by the operator by actuating the control member 12, and in particular a quantitative value produced by the action of the operator on the control member 12 and representing a speed level requested by the operator. For example, the quantitative value is an angle of inclination of a pivoting lever of the control member 12, in which a larger angle represents a request for higher speed and a zero angle of inclination (neutral position) represents a stopping request. The control system immediately produces the stopping of the movement in response to the stopping request produced by the operator.

Figure 2:
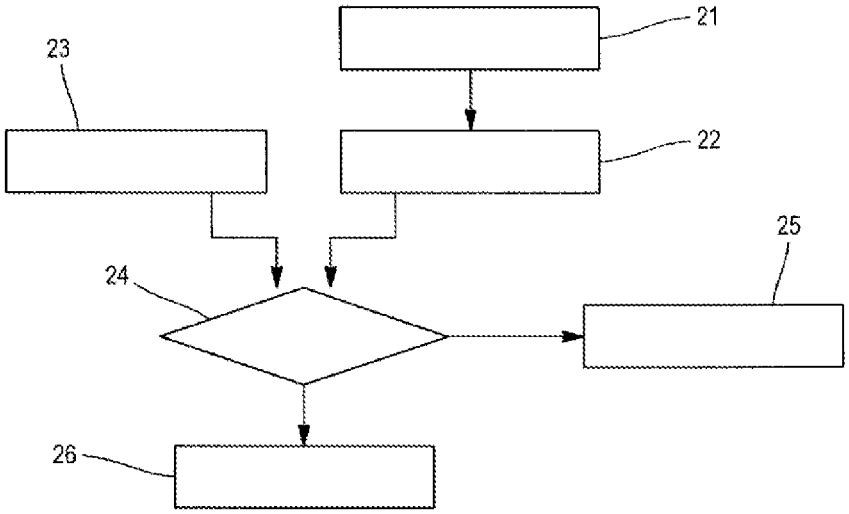
FIG. 2 is a flow chart showing a control method according to a first embodiment of the enhanced operating mode that can be used on the telescopic lift truck.

FIG. 2 illustrates a control method using a measurement of the actual speed of the handling arm 6. FIG. 3 illustrates a control method using a speed request produced by the operator. These methods can be performed in a loop by an electronic circuit.

The method in FIG. 2 includes the following steps:

Step 21: acquiring the measuring signal from the overturning moment indicating sensor 11.

Step 22: determining a permitted speed threshold as a function of the measuring signal. This determination can be based on reading a table stored in a memory and containing threshold values associated with measuring signal values or measuring signal value ranges.

Step 23: acquiring the measuring signal from a speed sensor of the handling arm 6. This speed sensor is for example an angular speed sensor 18 as shown in FIG. 1.

Step 24: comparing the speed of the handling arm 6 with the permitted speed threshold.

If the speed measured is below the permitted speed threshold, step 25: performing or continuing to perform the movement in accordance with the movement request produced by the operator.

If the speed measured is above the permitted speed threshold, step 26: stopping or preventing the movement of the handling arm 6, despite the operator's request. This stopping or prevention results from the fact that the operator has requested a speed of movement that is too high relative to the stability reserve available at that time. The control system does not authorize the performance of this request. In other words, if a movement was under way, it would stop immediately, and if no movement was under way, the stopped state would remain despite the operator's request.

From the stopped state produced in step 26, it is preferable to require a positive reset action by the operator before he can make a new movement request, for example a new request with a lower speed. This reset action can preferably be performed by means of the control member 12, for reasons of ergonomics. For example, the reset action consists of returning the pivoting lever to the neutral position before inclining it forwards again.

The permitted speed threshold read in step 22 can be determined by tests. Qualitatively, this permitted speed threshold represents a quantity of movement or the kinetic energy that the handling truck 1 is capable of absorbing without overturning if the movement of the handling arm 6 stops instantaneously. This permitted speed threshold therefore decreases during a lowering movement of the handling arm 6, as the stability reserve indicated by the measurement from the overturning moment indicating sensor 11 decreases. In another embodiment, the permitted speed threshold can be determined by calculation and stored, or can be determined by a real-time calculation in step 22.

One effect of the control method described above is therefore that, starting from the top position illustrated in FIG. 1, if the operator produces a constant lowering movement request, the movement is performed at a constant speed while the permitted speed threshold remains above this speed, and is interrupted instantaneously when the permitted speed threshold is exceeded.

As the control system reacts uniformly to a given movement request, and in particular does not modify the speed of movement performed in response to a given request, the operator is able to acquire by experience in-depth knowledge of the machine's response and to adjust his request to best suit the circumstances.

Figure 3:
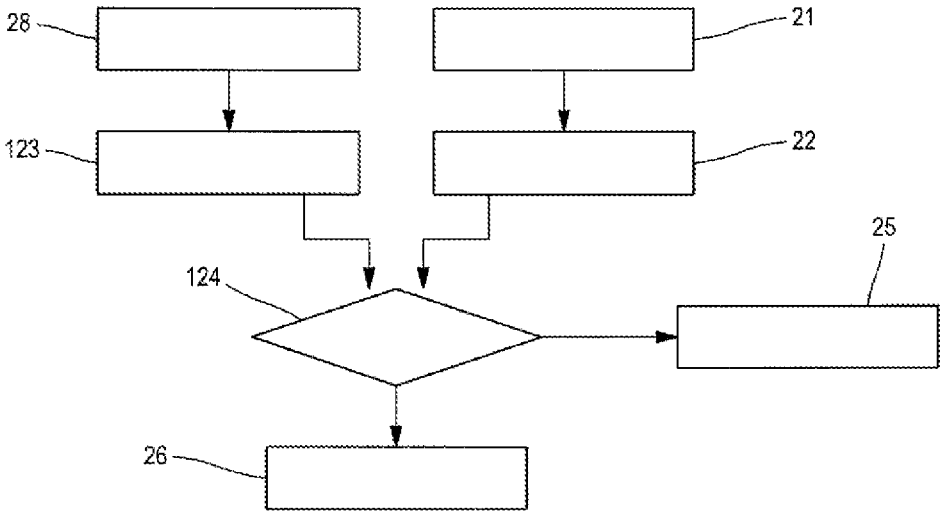
FIG. 3 is a flow chart showing a control method according to a second embodiment of the enhanced operating mode that can be used on the telescopic lift truck.

In FIG. 3, the steps that have been modified compared to the method in FIG. 2 have the same reference sign increased by 100. The unchanged steps have the same reference sign and are not described again.

Step 28: acquiring the movement request signal produced by the operator, for example in the form of an electric signal.

Step 123: determining a requested speed of movement as a function of the movement request signal. For example, the requested speed is encoded in the amplitude or another attribute of the movement request signal.

Step 124: comparing the requested speed of movement with the permitted speed threshold.

If the requested speed is below the permitted speed threshold, step 25.

If the requested speed is above the permitted speed threshold, step 26.

It will be understood that in these methods, no movement is performed other than a movement in accordance with the movement request produced by the operator.

The control system making it possible to perform such a control method can be produced in different ways. Three embodiments will now be described with reference to FIGS. 4 to 6.

Figure 4:
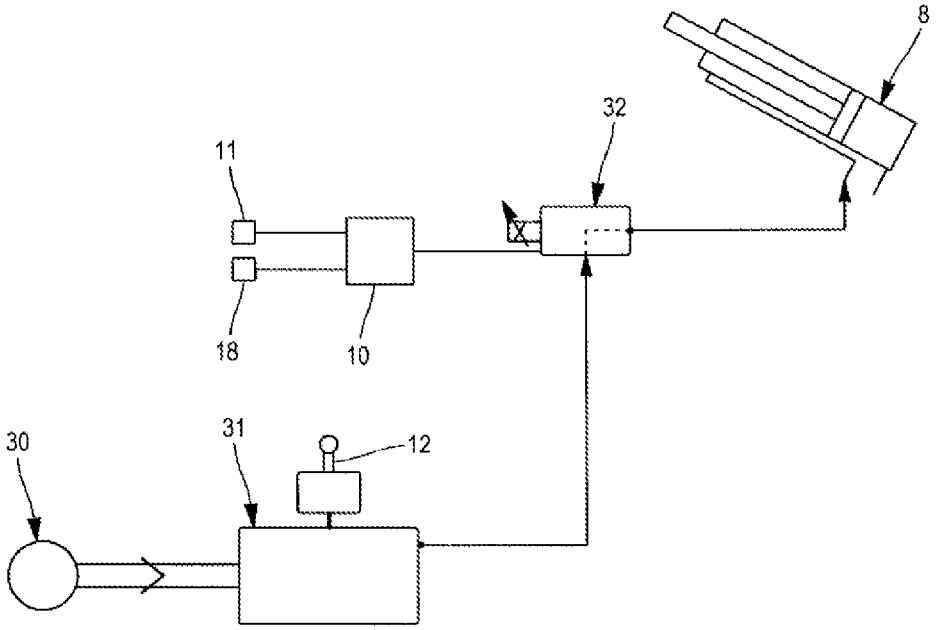
FIG. 4 is a diagrammatic representation of a hydraulic actuating device according to a first embodiment that can be used on the telescopic lift truck.

In FIG. 4, the control system is suitable for implementing the method in FIG. 2. It shows the hydraulic cylinder 8, a hydraulic pressure source 30, a hydraulic spool valve 31 inserted between them to control a hydraulic flow to be supplied to the hydraulic cylinder 8, the control member 12 in the form of a lever directly coupled to the slider of the hydraulic spool valve 31, the control unit 10, the overturning moment indicating sensor 11 and the angular speed sensor 18 connected to the control unit 10, and a solenoid valve 32 inserted between the hydraulic spool valve 31 and the hydraulic cylinder 8. The solenoid valve 32 is controlled by the control unit 10.

In this system, as the control unit cannot prevent the opening of the hydraulic spool valve 31 under the action of the operator when the speed is too high, the solenoid valve 32 is used to interrupt the hydraulic flow to stop the movement immediately in step 26.

Preferably, the solenoid valve 32 is a progressive start-up valve. Using a progressive start-up valve makes it possible for any restarting of the movement by the operator after the reset action not to take place too quickly relative to the speed measurement taken by the speed sensor 18.

Figure 5:
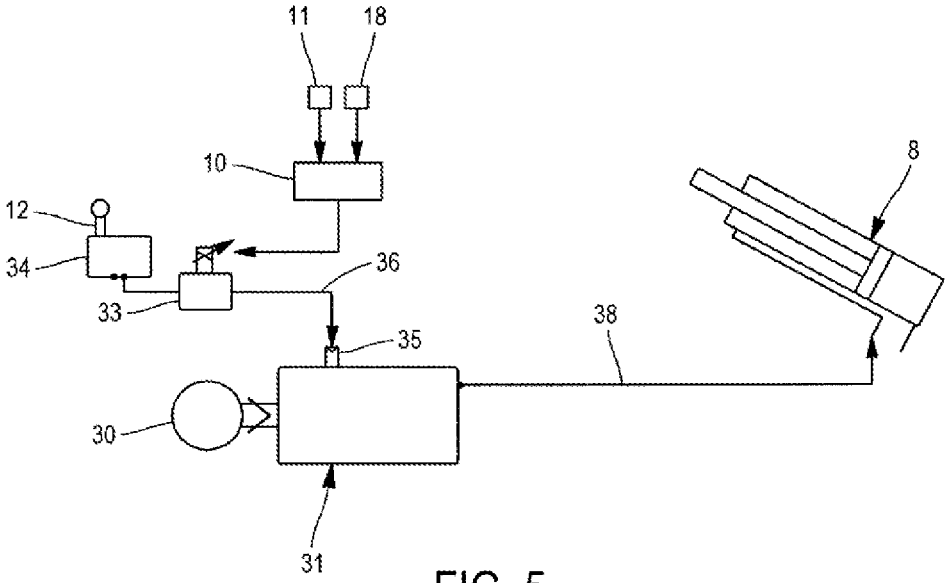
FIG. 5 is a diagrammatic representation of a hydraulic actuating device according to a second embodiment that can be used on the telescopic lift truck.

In FIG. 5, similar or identical elements to those in FIG. 4 have the same reference sign. In this embodiment, the hydraulic spool valve 31 does not have a mechanical control linked directly to the control member 12, but it has a hydraulic control. In particular, the hydraulic flow 38 corresponding to the lowering movement of the handling arm 6 can be obtained by sending a pilot pressure 36 to a control port 35.

The control member 12 is coupled to a control valve 34 controlling this pilot pressure. The control unit 10 is configured for controlling a solenoid valve 33 arranged between the control valve 34 and the control port 35. Thus, in step 26, the control unit 10 can switch the valve 33 to return the hydraulic spool valve 31 to the neutral position. Preferably, the solenoid valve 33 is a progressive start-up valve.

Figure 6:
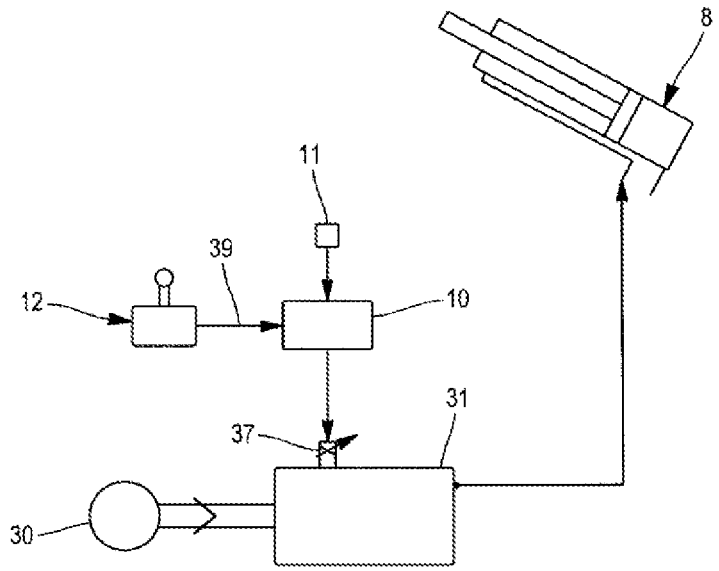
FIG. 6 is a diagrammatic representation of a hydraulic actuating device according to a third embodiment that can be used on the telescopic lift truck.

In FIG. 6, the control system is suitable for implementing the method in FIG. 3. The control member 12 produces electric request signals 39 and the hydraulic spool valve 31 is controlled using an electric signal applied to a control port 37. The control unit 10 is inserted between the control member 12 and the hydraulic spool valve 31 and can therefore directly control the hydraulic spool valve 31 in steps 25 and 26. A speed sensor of the handling arm 6 is not essential in this embodiment, as the control unit 10 can determine the speed requested directly from the request signal 39.

Figure 7:
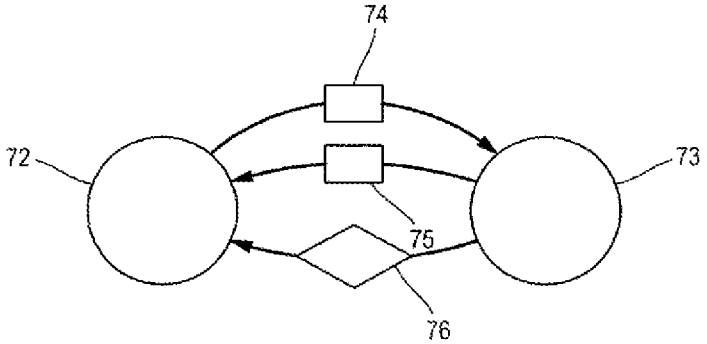
FIG. 7 is a diagram showing a state machine that can be used on the telescopic lift truck.

FIG. 7 shows a state machine that can be implemented by the control unit 10 for selectively activating the enhanced operating mode described above and a simple operating mode.

More specifically, the state machine includes an "enhanced operating mode" state 72 in which the control unit 10 implements the enhanced operating mode described above to take into account inertial forces, in particular in conditions in which the prediction of the inertial forces based on the speed has a degree of accuracy due to the fact that the chassis 2 is stationary, and a "simple operating mode" state 73 in which the control unit 10 implements a different operating mode, without taking into account the speed of movement of the handling arm. The simple operating mode nevertheless ensures a certain stability of the telescopic lift truck.

In state 73, the control unit 10 implements a method for controlling the handling arm 6 that is essentially based, for example, on the overturning moment measurement, performing the requested movement while the overturning moment is below a predefined threshold, and stopping the movement as soon as the overturning moment crosses this threshold. The stopping condition is therefore the crossing of the predefined threshold by the overturning moment indicating measuring signal. With regard to the sensor 11 positioned level with the rear axle, its measuring signal (resulting for example from the bending of a wheel shaft) will decrease as the overturning moment increases. The stopping condition can therefore more specifically be the measuring signal from the sensor 11 falling below a threshold. It will be understood that the requested movement can be a combination of movements and is not restricted to an individual movement.

Returning to FIG. 1, a selection member 70 is shown in the cab of the telescopic lift truck. The selection member 70 is intended to be actuated by the operator for selecting the enhanced operating mode or the simple operating mode as he chooses. Thus, as shown in FIG. 7, from state 72, the operator can apply a first action 74 to the selection member 70 to switch to state 73. Likewise, from state 73, the operator can apply a second action 75 to the selection member 70 to switch to state 72. Depending on how the selection member 70 is actually produced, the first action 74 and the second action 75 can be identical actions, successive in time, for example if the selection member 70 is a push-button alternately switching to state 72 and state 73 on each successive press that it receives. Conversely, the first action 74 and the second action 75 can be different actions, for example if the selection member 70 is a bistable member that can be moved selectively to a first stable position to switch to state 72 and to a second stable position to switch to state 73.

FIG. 7 also shows that the control unit 10 in state 73 permanently tests a return condition 76 in order to return to state 72 as soon as the return condition 76 is met.

The return condition is based on detecting that the chassis 2 of the telescopic lift truck is in a substantially stationary state for a duration greater than a predetermined threshold. One criterion that can be applied to detect the substantially stationary state is that the travelling speed of the chassis 2 is below a predefined threshold, for example 0.3 m/s. To test the return condition 76, the control unit can measure a quantity representing the travelling speed of the chassis 2 and compare this quantity to the predefined threshold.

The return condition 76 can also include several alternative or cumulative conditions implying that the body of the machine is substantially stationary. In one embodiment, the return condition 76 is also met as soon as one of the following events is detected:

- activation of a parking brake,
- deactivation of a transmission (disengagement by solenoid valve or electric control relay),
- lowering of the stabilizing legs 5 so that they are resting on the ground, demonstrating the intention to stabilize the machine by lifting the wheels off the ground.

A number of techniques can be used to measure a quantity representing the travelling speed of the chassis 2, for example by applying the measurements supplied by one or more wheel speed sensors 71, which are illustrated diagrammatically in FIG. 1.

The duration threshold can be set as a function of the requirements of the given application, for example between 1 s and 1,000 s, and preferably between 5 s and 100 s.

Other control systems can be envisaged depending on the nature of the actuator to be controlled. The handling arm 6 can have degrees of movement other than pivoting about the horizontal axis 7, particularly a degree of telescoping linear movement and a degree of pivoting of the implement about a horizontal axis 15. The control methods described above can be used to control one or more of these degrees of movement. When several degrees of movement are present, the actuators responsible for performing the corresponding movements are not necessarily all controlled in the same way. It will be understood that the requested movement can be a combination of movements and is not restricted to an individual movement.

Figure 8:
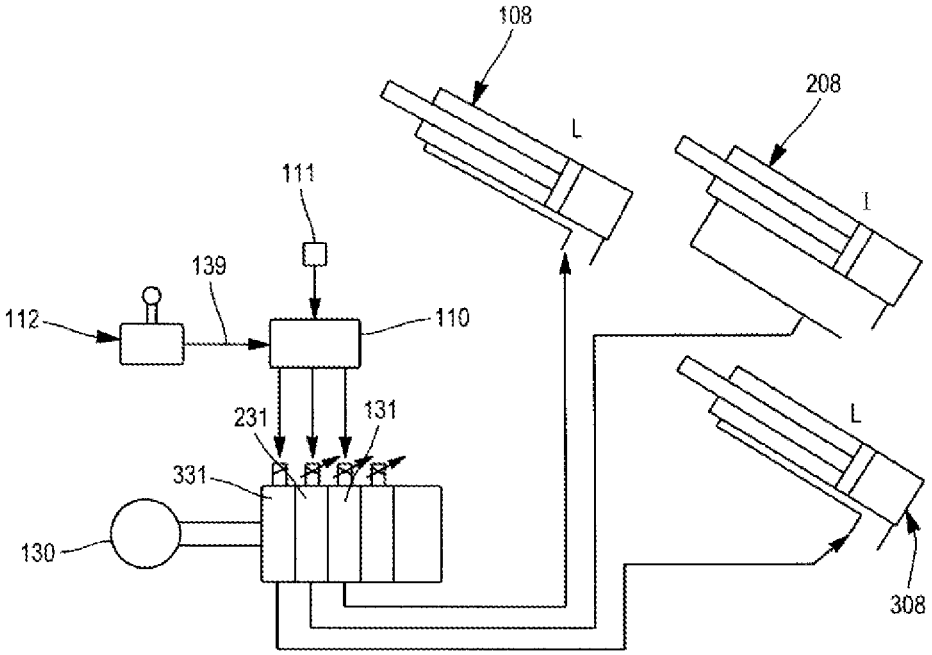
FIG. 8 is a diagrammatic representation of a hydraulic actuating device according to a fourth embodiment that can be used on the telescopic lift truck.

FIG. 8 illustrates another system for controlling the movements of the handling arm 6. This system shows three actuators responsible for the movements in three different degrees, namely:

- a lifting/lowering actuator 108 responsible for the pivoting movements about the axis 7, denoted lifting L+ and lowering L−, controlled by a hydraulic spool valve 131,
- a telescoping actuator 308 responsible for the translational movements along the axis of the handling arm 6, denoted extension T+ and retraction T−, controlled by a hydraulic spool valve 231, and
- an implement actuator 208 responsible for the pivoting movements of the implement about the axis 15, denoted raising I+ and lowering I−, controlled by a hydraulic spool valve 331.

By way of illustration, the hydraulic spool valves 131, 231, 331 are electrically-controlled spool valves. The same reference signs as in FIG. 6 are therefore used to denote identical or similar elements.

The methods for stopping the movements described above can of course be applied to the lowering movement L−, as already described, but also to the extension movement T+ and optionally to other movements.

When the control unit 10 stops or automatically prevents a movement, due to the stopping condition being met, certain degrees of movement can still be performed by the operator while others are prohibited. Preferably, the lifting movement L+ and the retraction movement T− can still be performed as they contribute to reducing the overturning moment.

The degrees of movement that can still be performed when the stopping condition for one movement is met are not necessarily the same in state 72 and state 73. For example, when the stopping condition for a lowering movement L− is met in state 72 (enhanced operating mode selected), the raising and lowering movements I+, I− are also prohibited, whereas these movements can still be performed when the stopping condition for a lowering movement L− is met in state 73 (simple operating mode selected).

Figure 9:
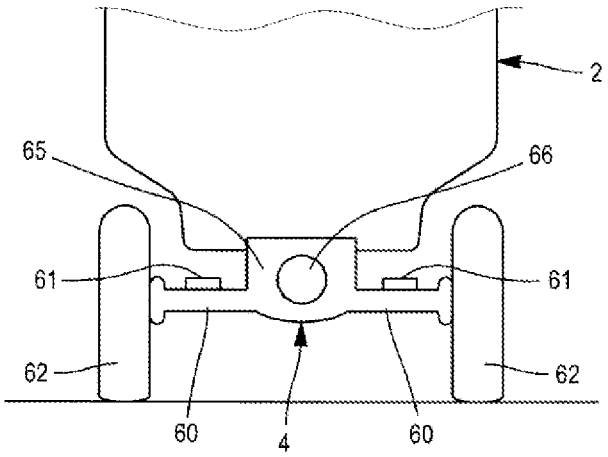
FIG. 9 is a diagrammatic representation of a wheel shaft provided with a strain gage that can be used as an overturning moment indicating sensor.

FIG. 9 shows an embodiment of the rear axle 4 of the telescopic lift truck 1. The rear axle 4 includes two wheel shafts 60 holding the rear wheels 62. One or each of the wheel shafts 60 is provided with a strain gage 61 arranged to measure deformations of the wheel shaft 60 in bending. More specifically, the strain gage 61 measures the variation in length between two terminals spaced apart on the wheel shaft 60. The measuring signals from the strain gages 61 can be used to form the overturning moment indicating signal, for example as an average of the two measuring signals. Alternatively, it is possible to use a single strain gage 61 to produce the overturning moment indicating signal. Preferably, the rear axle 4 is connected in an oscillating manner to the chassis 2 by means of a pivot 66 with a longitudinal axis passing through a central part 65 of the axle.

Some elements shown, particularly the control unit, can be produced in different forms, individually or generally, by means of hardware and/or software components. Hardware components that can be used are application specific integrated circuits (ASIC), field programmable gate arrays (FPGA), or microprocessors. Software components can be written in different programming languages, for example C, C++, Java or VHDL. This list is not exhaustive.

The methods and systems described above in the context of a telescopic lift truck are applicable to other handling machines.

Although the invention has been described with reference to several specific embodiments, it is obvious that it is in no way limited thereto and that it comprises all technical equivalents of the means described and any combinations thereof if these fall within the scope of the invention.

The use of the verb "include" or "comprise" and its conjugated forms does not rule out the presence of elements or steps other than those set out in a claim. The use of the indefinite article "one" for an element or a step does not rule out, unless otherwise stated, the presence of a plurality of such elements or steps.

In the claims, any reference sign in brackets cannot be interpreted as limiting the claim.

The invention claimed is:

1. A control method for controlling an actuating device in a handling machine including a mobile main body and a handling arm intended to receive a load to be moved, the actuating device being configured for performing a movement of the handling arm relative to the main body, the method including:

measuring a quantity indicating an overturning moment applied to the main body relative to an overturning axis, and stopping or preventing a movement of the handling arm performed or requested as soon as a stopping condition is met, the stopping condition being dependent on the measured quantity indicating the overturning moment, and in which, when an enhanced operating mode is selected, the stopping condition is also dependent on a quantity representing the speed of the movement of the handling arm, and when a simple operating mode is selected, the stopping condition is independent of the quantity representing the speed of the movement of the handling arm.

2. The method as claimed in claim 1, also including:

selecting the enhanced operating mode in response to a first action by an operator on the selection member, and selecting the simple operating mode in response to a second action by an operator on the selection member.

3. The method as claimed in claim 2, also including:

selecting the enhanced operating mode in response to the detection of the fact that the main body has remained in a substantially stationary state for a duration longer than a predetermined threshold.

4. The method as claimed in claim 3, also including:

measuring a quantity representing a travelling speed of the main body, and detecting that the main body has remained in the substantially stationary state as a function of the quantity representing a travelling speed of the main body.

5. The method as claimed in claim 1, also including:

selecting the enhanced operating mode in response to the detection of the activation of a parking brake, the deactivation of a transmission or the lowering of stabilizing legs so that they are resting on the ground.

6. The method as claimed in claim 1, also including:

measuring an instantaneous speed of the handling arm relative to the main body as the quantity representing the speed of the movement of the handling arm.

7. The method as claimed in claim 1, also including:

receiving a movement request signal intended to influence the actuating device to have a movement of the handling arm performed by the actuating device, the movement request signal having an attribute representing a speed of the movement to be performed, determining the quantity representing the speed of the movement of the handling arm as a function of the attribute of the movement request signal.

8. The method as claimed in claim 1, in which, when the enhanced operating mode is selected, the method also includes:

determining a threshold representing a maximum permitted speed as a function of the quantity indicating the overturning moment, comparing the quantity representing the speed of the movement performed or to be performed to the threshold representing a maximum permitted speed, and controlling the actuating device as a function of the result of said comparison, so as to:

perform or continue the movement of the handling arm while the quantity representing the speed of the movement performed or to be performed is below said threshold representing a maximum permitted speed, and prevent or stop (26) the movement of the handling arm as soon as the quantity representing the speed of the movement performed or to be performed is above said threshold representing a maximum permitted speed.

9. The method as claimed in claim 8, in which the threshold representing a maximum permitted speed decreases when the overturning moment increases.

10. The method as claimed in claim 1, in which, when the simple operating mode is selected, the method also includes: preventing or stopping the movement of the handling arm as soon as the quantity indicating an overturning moment has crossed a predetermined threshold.

11. A handling machine including:

a main body, a handling arm intended to receive a load to be moved, an actuating device configured for performing a movement of the handling arm relative to the main body, an overturning moment indicating sensor sensitive to a quantity indicating an overturning moment applied to the main body relative to an overturning axis, a control unit configured for controlling the actuating device so as to stop or prevent a movement of the handling arm performed or requested as soon as a stopping condition is met, the stopping condition being dependent on the measured quantity indicating the overturning moment, and a selection member that can be actuated by an operator for selecting a simple operating mode and an enhanced operating mode, in which, when the enhanced operating mode is selected, the stopping condition employed by the control unit is also dependent on a quantity representing the speed of the movement of the handling arm performed or requested, and when the simple operating mode is selected, the stopping condition is independent of the quantity representing the speed of the movement of the handling arm.

12. The machine as claimed in claim 11, in which the selection member is configured for:

selecting the enhanced operating mode in response to a first action by the operator on the selection member, and selecting the simple operating mode in response to a second action by the operator on the selection member.

13. The machine as claimed in claim 11, in which the control unit is configured for selecting the enhanced operating mode in response to the detection of the fact that the main body has remained in a substantially stationary state for a duration longer than a predetermined threshold.

14. The machine as claimed in claim 13, also including:

a travelling speed sensor configured for measuring a quantity representing a travelling speed of the main body, and in which the control unit is configured for detecting that the main body has remained in a substantially stationary state as a function of the quantity representing a travelling speed of the main body.

15. The machine as claimed in claim 11, also including means for measuring an instantaneous speed of the handling arm relative to the main body as the quantity representing the speed of the movement of the handling arm.

* * * * *